US005320180A

United States Patent [19]

Ruley et al.

[11] Patent Number: 5,320,180

[45] Date of Patent: Jun. 14, 1994

[54] DUAL ANTENNA RADIO FREQUENCY LOCATING APPARATUS AND METHOD

[75] Inventors: David A. Ruley, Brenham; Frank C. Forest, Richmond, both of Tex.

[73] Assignee: Sharewell Inc., Stafford, Tex.

[21] Appl. No.: 958,281

[22] Filed: Oct. 8, 1992

[51] Int. Cl.[5] ..... E21B 47/022; E21B 47/09

[52] U.S. Cl. ..... 175/26; 175/45; 33/304; 324/329

[58] Field of Search ..... 175/26, 45, 40, 61, 175/62; 33/304, 313; 324/326, 329, 346

[56] References Cited

U.S. PATENT DOCUMENTS

| | | | |
|---|---|---|---|
| 3,529,682 | 9/1970 | Coyne et al. | 175/45 |
| 3,589,454 | 6/1971 | Coyne | 175/26 |
| 3,712,391 | 1/1973 | Coyne | 175/26 |
| 3,718,930 | 2/1973 | McCullough et al. . | |
| 3,746,106 | 7/1973 | McCullough et al. | 175/45 |
| 3,900,878 | 8/1975 | Tsao . | |
| 3,975,735 | 8/1976 | McCullough et al. . | |
| 4,787,463 | 11/1988 | Geller et al. | 175/45 |
| 4,875,014 | 10/1989 | Roberts et al. | 324/326 |
| 4,881,083 | 11/1989 | Chau et al. | 175/26 X |
| 4,993,503 | 2/1991 | Fischer et al. | 175/62 |
| 5,165,490 | 11/1992 | Nosaka | 175/45 |
| 5,208,538 | 5/1993 | Sakanishi et al. | 175/45 X |

*Primary Examiner*—David J. Bagnell
*Attorney, Agent, or Firm*—Donald Gunn

[57] ABSTRACT

The present method and apparatus are directed to river crossings and the like. A horizontal drilling rig is set up and drills under a body of water or the like. Angular measurement sensors carried at the drill bit provide data periodically which is transmitted from a transmitter at the end of the drill string. Two antennas are deployed, the two being parallel strips spaced equally on the left and right of the right of way. They connect with two receivers. The transmitted angular data is used to determine the location of the drill bit. Progressive determinations of the transmitter enable determination of the trajectory during drilling. The two antennas are used to provide redundant reception of the transmitted signal. In addition to that, a quick reading of lateral drift is obtained by measuring the ratio of the received signals. The two antennas have the form of flat strips which can be deployed across the terrain, over a river, and the like.

19 Claims, 1 Drawing Sheet

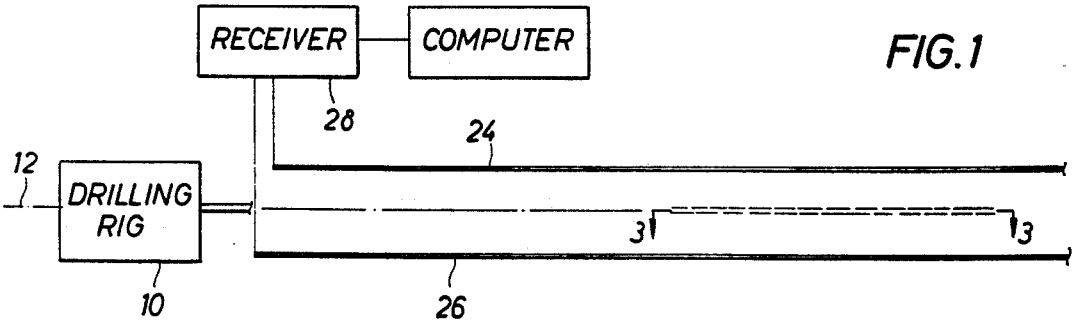
FIG.1
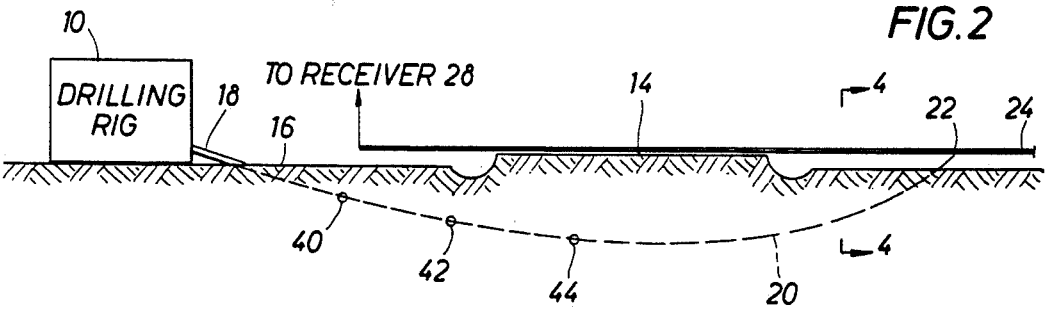
FIG.2
FIG.3
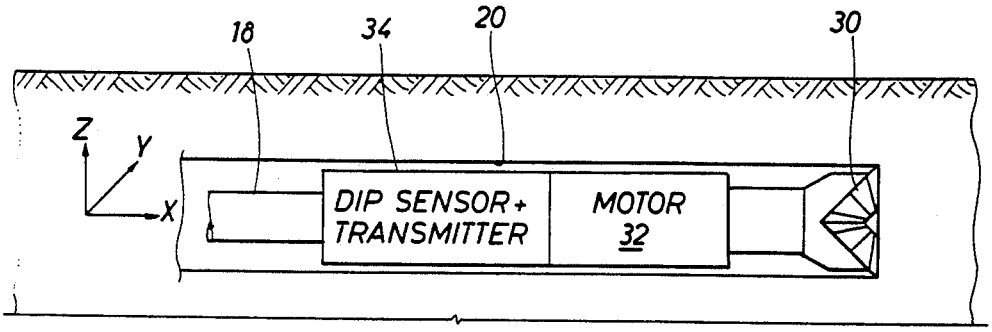
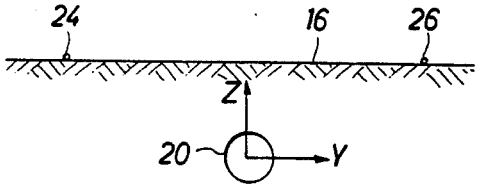
FIG.4
FIG.5
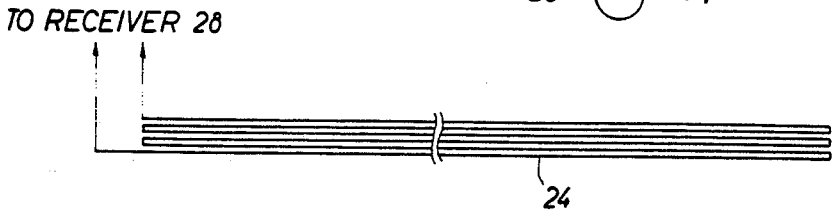

DUAL ANTENNA RADIO FREQUENCY LOCATING APPARATUS AND METHOD

BACKGROUND OF THE DISCLOSURE

The present disclosure is directed to a dual antenna system which is useful in locating a drill bit assembly while drilling substantially horizontally under rivers, roads and in other circumstances where the well is substantially horizontal. Horizontal drilling is often used to cross under areas where trenching to bury a pipeline is forbidden. For instance, it may be necessary to cross under a river. Another situation is crossing under a large interstate highway with service roads which might be 250 feet in width. Another example is crossing under an airport runway. In other instances, it may be necessary to drill horizontally to cross under a housing development and the like. In situations of this sort, it is necessary to drill substantially horizontally and yet to know where the drill bit is located during the process of drilling so that the drilled well is formed within a confined region. Typically a designated right of way is furnished for this.

Consider a relatively simple case in which a pipeline is directed at right angles to a river. Assume that the river and the adjacent bank areas are 300 feet in width, and has a water depth of 25 feet. An alternate situation will involve the above mentioned interstate highway. The present apparatus is a system which enables the pipeline to be directed across that area subject to control so that it does not deviate or wander to the right or left. For instance, assume the right of way (ROW hereafter) is 50 feet wide, the drilling rig is situated at one edge of the river or the highway and drilling is initiated from that location. The present apparatus enables the drilling to be carried out so that the drilled hole is in the ROW, and is located at the desired depth. The depths typically range just below the surface. For instance, in passing under a large highway it may be necessary to proceed at a depth of only about 10 feet. Drilling continues until the drill bit is directed back to the surface at the far side. This completes the transhighway tunneling job which can then be interconnected with the remainder of the pipeline, typically constructed by trenching techniques.

The present apparatus enables the crossing to be carried out in a fashion which avoids the difficulties with trenching across the highway or under water, etc. There are multiple techniques available for carrying out such a process. For example, the Goldak firm is the owner of several patents including U.S. Pat. Nos. 3,718,930, also 3,746,106, and 3,975,735. They show structures which are intended to deal with this problem but which are different in operation. There are several patents issued to Coyne which include U.S. Pat. Nos. 3,529,682, also 3,589,454 and also 3,712,391. They all use a certain type of antenna system more specifically set forth. Recently issued U.S. Pat. No. 4,875,014 shows a system using a closed loop antenna laid on the ground which conducts a very substantial current flow. The loop forms a field which is sensed underground. U.S. Pat. No. 4,881,083 uses two antennas which are arranged at a right angle. By contrast with all the foregoing, the present system utilizes a pair of looped antennas which are arranged parallel to the intended pathway of the pipeline. For instance, in passing under a large highway, the present apparatus utilizes two antennas which have the form of thin strips with two or more conductors in each strip. The two antennas are preferably identical. Each antenna is formed of one or more loops, typically a whole number integer where N=2 up to about 100. Each loop antenna has a length which is sufficient to extend beyond where the drill bit is located. For instance, the two loops can each be 100 feet in length, and yet only 1 inch in width, formed of planar material and thereby able to lay flat on the ground. This permits their use over a highway and the like. The two loops are used to receive transmitted signals. However, while two are used, they serve only one directional aspect. They are used to determine centering of the transmitter between the two loops, and that is obtained by a ratio measurement between the two antenna signals. The antennas are preferably constructed with duplicate turns and length. In the system, a drill bit is attached to a motor and is rotated. Immediately adjacent to the motor, the equipment includes a dip sensor arranged to describe the dip orientation of the drill bit. The present apparatus relies on the dip sensors deployed in space to measure the drill bit angle. The angular measurement is coupled with added information regarding the length of drill pipe from the drilling rig to the transmitter, and that enables determination of the location of the drill bit.

The present apparatus is thus summarized as a drilling system which includes a dip sensor located at the drill bit which connects to a transmitter which transmits the measurements from the sensor. In the preferred embodiment, the length of drill pipe extending from the drilling rig is measured. The sensor provides dip angle which help locate in space the end of the column of drill pipe so that its location is known. A dual antenna system is included where two loop antennas are placed lengthwise along the right of way. While they are loop antennas, they are sufficiently narrow that they have an infinitely thin construction. Both receive the transmitted signal. However, they are not used for locating the drill bit depth or direction of drilling. They are used to provide left and right movement of the drill bit.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a plan view showing a drilling rig in accordance with the present disclosure positioned over a right of way to extend a horizontal passage through the earth along the ROW which is permitted for drilling horizontally;

FIG. 2 is a view orthogonal to FIG. 1 showing how the drilling rig drills at an angle into the earth so that horizontal drilling is accomplished, and further showing an antenna deployed on the ground above the pathway of the horizontally drilled hole, and further wherein the trajectory is incorporated in a pipeline or the like on crossing under a river, highway or other obstacle;

FIG. 3 is a sectional view taken along the line 3—3 showing the end of the equipment affixed to the drilling rig which supports a string of drill pipe and which also supports a motor and drill bit for advancing the hole and further including sensors connected with the transmitter;

FIG. 4 is a view along the line 4—4 in FIG. 3 of the drawings showing the twin antenna system positioned on the ground above the pathway of the drill bit; and FIG. 5 shows an antenna.

DETAILED DESCRIPTION OF THE PREFERRED EMBODIMENT

Attention is now directed jointly to FIGS. 1 and 2 which will be described in some detail before going to a description of FIGS. 3 and 4. The description of the apparatus will proceed with the apparatus in operation. To this end, the entire drilling system must be described first before going on to the equipment of the present disclosure. FIG. 1 shows a drilling rig 10 which is positioned approximately on the center line of a right of way, indicated by the reference line 12, and that is extended through the drilling rig and through or over some kind of obstacle. The obstacle is indicated in FIG. 2 of the drawings as a major road which is identified at 14. The road 14 is shown with an elevated road bed and also with drainage ditches next to the sides of the road. Suffice it to say, the precise profile is subject to variation. Indeed, there can be a river or other body of water. The ground surface is level as indicated by the line 16 but it can just as easily be irregular.

The line 12 marks the direction of ROW which has a buried pipeline in it. The buried pipeline is brought up to the drilling rig 10. The drilling rig 10 is located on the ROW so that it can form a continuation of the passage for the pipeline except that it is accomplished without trenching. The drilling rig 10 connects with a pipe 18 which extends out of the drilling rig and enters the ground 16. It forms an underground trajectory 20 which extends from the drilling rig along the ROW 12 for a fixed distance. In general terms, the hole 20 is not horizontal. It is however controlled so that, during drilling, the hole 20 is formed extending from the surface near the drilling rig downwardly so that it passes sufficiently below the barrier 14 that it does not harm the barrier. For instance, if it crosses under a roadway, it is sufficient that it go beneath the built up material under the roadway such as the foundation of gravel, reinforcing bars and the like. If the obstacle 14 is a body of water it is generally desirable that the drill hole pass substantially under the body of water. This in part depends on the nature of the soil and the tendency of that soil to exclude water filtration from the body of water into the drilled passage 20. The passage 20 has an entrance portion where the drill pipe 18 extends from the drilling rig downwardly at a modest angle. The central portions of the passage 20 are substantially horizontal. At the far end, the drilling process is then deflected upwardly so that the drilled hole extends back to the surface 16. This typically occurs near the projected surface location 22 shown in FIG. 2 of the drawings.

Duplicate antennas are deployed along the ROW 12. They are indicated by the numerals 24 and 26 in FIG. 1 and 5 of the drawings. They are both connected to a receiver 28. The receiver 28 is a dual channel receiver meaning it has duplicate receiver sections. The antennas 24 and 26 are duplicate. They are looped antennas which are formed of N loops where N is a whole number integer and is preferably at least about 2 up to about 100, and acceptable range being about 10 to 50. In terms of fabrication, the loops are formed by utilizing ribbon wiring with 2N conductors in them. It requires two conductors extending the full length of the ribbon to form a single loop. The loop is formed by attaching the two conductors at the remote end and connecting the near end with the receiver. So to speak, the loop antenna has an opening in the loop which is substantially zero. The loop, formed in this fashion, has an infinitely thin opening but a length which is cut to size. The antenna length can be varied, for instance it can be made as short as 50 feet or it can be as long as 300 feet.

Having the form of a multiple conductor flat ribbon which is equipped with N loops of narrow width and fixed length, the ribbon like material is deployed on the surface preferably on a straight line assuming that the terrain permits this. Rise and fall of the surface can be accommodated by simply placing the parallel antennas 24 and 26 over the irregular terrain.

Going now to FIG. 3 of the drawings, the drilled hole 20 is shown below the surface. The drilled hole is formed by the equipment attached at the end of the drill pipe 18. This includes a drill bit 30 which is rotated by some type of drill motor 32. The motor 32 is supported at the end of the drill pipe 18 and rotates the drill bit. The motor and bit can be steered to control the drilling direction. Wet or dry drilling techniques can be used. To form the drilled hole, it is desirable to wash cuttings from the well back through the passage 20. As the motor 32 rotates the drill bit 30, the hole 20 is advanced. The movement or direction of the hole is determined with respect to an XYZ reference system and such a representative coordinate system is illustrated in FIG. 3.

The equipment which is immediately adjacent to the drill bit 30 further includes a dip sensor arranged to measure dip below or above the horizon. A transmitter is likewise included and all of the foregoing is located in a housing 34.

FIG. 3 shows the drill pipe 18 which extends along the drilled substantially horizontal passage 20 and has been represented in FIG. 3 as parallel to the ground surface 16 above, this depiction being an idealized condition. In actuality, the surface as mentioned can be irregular in slope and grade. In addition to that, the drilled hole 20 will typically deflect downwardly at the central regions of the drilled hole approximately half way between the point of entry and exit. In drilling, it is not uncommon for the hole length to be 300 feet while the depth is only 15 to 30 feet. This relatively shallow depth materially assists in determining the pathway of the drill passage 20. Certain trigonometric determinations are somewhat simplified as will be explained. It is drilled to a depth to assure that there is vertical clearance between the drilled hole and the obstacle on the surface such as the foundation of a highway, the beds beneath rivers and the like. Suffice it to say, the pathway 20 is determined in advance. The apparatus and procedure which is important to accomplish the passages 20 are worth noting. FIG. 4 of the drawings shows one aspect of the control system. In FIG. 4 the two antennas 24 and 26 are shown on the surface. In addition, the drilled passage 20 is also shown at some depth beneath the surface. The coordinate system shows that movement to the left or right of the hole 20 is movement is in the Y dimension. The X dimension is along the length of the hole as shown in FIG. 3. Vertical displacement is the Z dimension as shown in FIGS.

3 and 4. The system utilizes coordinates which are at right angles with respect to each other. A dip sensor provides a measurement of dip angle with respect to a gravity defined coordinate system. A suitable apparatus is the Microarc series of transducers from the Fredericks Company of Pennsylvania. For instance, they provide a series 0727 narrow angle transducer. It provides a null output signal at a tilt angle of 0° while a tilt angle of 1° is represented by about 525 milivolts. Alternately, the same source provides a wide angle device which provides an output of about 1 volt at 45°. As will be understood, a dip sensor is arranged axially of the pipe and provides a null voltage at the reference angle in the orthogonal system. The dip angle provides data for determining the position in space of the sensor assembly 34 shown in FIG. 3. It can be further assumed that the sensor is located at the end of the drill pipe 18. This assumption involves the offset distance from the sensor package to the very end of the drill bit 30. Since that is a fixed distance of only a few inches which can be measured before placing the equipment in service, that can be determined readily. The dip sensor is used in conjunction with a CPU as shown in FIG. 1 to determine the trajectory 20 in the following fashion.

The transmitter 34 forms a signal periodically, for instance once per minute or once every ten seconds, of the dip angle which is an angular measurement. Dip angles are transmitted in some arbitrary and fixed data format. They are transmitted from the transmitter 34 and are received by the antennas 24 and 26. This is not an AM system; rather, it is preferably a digital data encoding system such as pulse width modulation (PWM) or the like. The data is transmitted, received by one or both of the antennas, and is output by the receiver 28 and is provided to the CPU. Signal amplitude in the transmission is not a significant factor in transmitting the data. In that sense, the data that is received can be obtained from either of the two antennas because the two antennas provide a redundant system. The data is decoded or demodulated, and is delivered to the CPU in the requisite data format.

Focusing first on the method of determining the location of the trajectory 20 under ground, the CPU is provided with a program which determines the location of the end of the hole 20. The hole is formed progressively. When first initiated, the drill bit is advanced in a direction determined by the pipe 18. As viewed from above in FIG. 1, the initial azimuth of the pipe 18 is known because it coincides with the ROW 12 when started. A first data point 40 is thus taken after the hole has progressed a few feet and the first data point is derived from the length of pipe which is measured and input to the CPU. For instance, drill pipe is normally provided in lengths of 30 feet. A precise measurement can be made using a steel tape. Careful measurements are made at the surface and the length of pipe is thus provided as an input data. At the first measurement 40, it can be assumed that the pipe coincides with the ROW line 12. The relative dip angle of the pipe can also be determined at that juncture, this being measured by the dip sensor; in particular the sensor that measures deviation from the horizontal. Dip angle is measured by the sensor at the end of the drill string. This provides a first location for the river crossing. This is represented in FIG. 2 of the drawings by the numeral 40 which identifies a first data point location which is input to memory. It is saved because the extension of the drilled passage 20 will continue to pass through that point. Later, another data point is determined at 42. Even later, another data point is determined at 44 and so on. Each of the data points will be determined progressively and will be added into memory to describe the trajectory of the drilled hole 20 from the far left end to the right end when completed. Progressively the data is determined and stored in memory. Each incremental advance of the drill string is occasioned by periodic measurements. For instance, they can arbitrarily be spaced by a specific distance, or readings can be taken after fixed intervals of time so that a number of data points are obtained. The data points are stored in memory to totally describe the pathway. Each data point is progressively extended from the drilling rig 10. This breaks up the river crossing into a number of incremental measurements. These provide a quality representation of the river crossing, it being kept in mind that the completed river crossing 20 must coincide with and pass through these several data points 40, 42 and 44.

The angles provided by the sensor are utilized in determining the location of the drill bit from the prior data point. In terms of the trigonometric determinations necessary to calculate this, the known data for determination of the data point 40 is the length of drill pipe, and the initial azimuth of the pipe. The inclination of the pipe with respect to a horizontal reference is measured at the beginning utilizing the dip sensor as mentioned. This enables trigonometric determination of the data point 40. In actuality, the dip sensor provides more data than is necessary to measure the location of the hole 20. Suffice it to say, dip angle is helpful to locate the drill bit in space with respect to the coordinate system shown in the drawings. As a generalization, the angle of the drill pipe along the trajectory is sufficiently shallow that a number of trigonometric approximations can be undertaken. For instance, in working with the cosine functions of angles of less than 5°, the cosine value approaches 1.000. Obviously, the calculations utilize trigonometric tables for all angles. However, implementation of these angles is readily accomplished. Accordingly, the first data point 40 is fixed or located and is recorded. The next data point 42 is determined with respect to the data point 40. Again, the length of pipe involved is known.

At some juncture, assume for purposes of description that a change in pathway has occurred for instance, the drilled river crossing 20 has deviated to the left or right in an unintended fashion. Whatever the case, when the sensor package 34 transmits the next measured angle, it will provide the angular dip measurement with respect to the coordinate system. This data is transmitted to the antennas 24 and 26 which provide redundant reception thereof, and the received signal is provided from the received 28 to the CPU. The angular measurement is input as noted. The next calculation is then determined. The next measurement involves the added length of pipe in the drill string 18. It also involves the angular measurement just mentioned. Progressively, data points are calculated and the pathway is fully determined.

The present apparatus provides a drift check which is very useful dynamically without requiring recalculation of the location of the drill bit. The antennas 24 and 26 are used in a comparison or ratio measurement. As viewed in FIG. 4, the two antennas are provided with a signal from the transmitter 34. The two received signals are compared in amplitude and a ratio is determined. If the ratio is 1.000, then the transmitter is located at the mid point of the two antennas. Since it is a relative ratio, depth cannot be determined by this measurement. However, lateral displacement from a center line location as shown in FIG. 4 is determined. In other words, drift in the Y dimension can be noted. This remains reliably available so long as the soil which comprises the transmission medium remains uniform. In view of the relative short distances involved, that typically is the case unless some extraordinary geology is encountered. For instance, a large collection of metal trash may have some impact on the received signal. In any event, the system operates on the relative ratio, not absolute values, and the ratio can be used to determine in a quick and easy fashion deviation of the drill hole from the desired spacing with respect to the two antennas 24 and 26.

It is generally desirable that the antennas be spaced horizontally on the ground by a distance of about two times the maximum hole depth. If the maximum depth desired in the river crossing is about 30 feet, then the two antennas should be up to about 60 feet in horizontal spacing from each other. However, they can also be somewhat closer because most of the river crossing 20 is formed at more shallow depths. Spacing of 20 feet is more than adequate for the shallow drilled hole. As will be understood, the antennas may be placed on the ground at a very close spacing when the drilling process begins, perhaps positioning them only 5 feet apart. When greater depths are required, the two antennas may be repositioned at greater spacing, perhaps 30 feet. As before, this is accomplished symmetrically along the ROW line 12.

Trajectory of the river crossing is determined on a point by point basis utilizing dip angle data. As mentioned, the length of drill pipe in the drill string is determined as the drill string is assembled. As also mentioned, the three angular measurements are transmitted from underground to the receiver as often as required. Indeed, that data can be provided so fast that it is not possible to utilize all of that data. If desired, the transmitter can be switched to send this data less often. Finally, it should be noted that the trajectory 20 is determined as a series of progressive points where the location 44 is determined with respect to the location 42 and so on. During drilling, this in fact is the manner in which drilling occurs. One departure from this occurs when the drill pipe key seats in the hole, and that is highly undesirable in any event. To the extent that key seating may occur, the drilled passage 20 may be distorted as a result of key seating.

The CPU normally outputs the trajectory cumulatively. This is accomplished by recording and showing on a monitor the data which is the intermediate points 40, 42, 44 and so on. Since it is initially referenced to the azimuth of the ROW line 12, it is convenient to indicate the trajectory with respect to the ROW extended as an imaginary line through the obstacle in front of the drilling rig. This data will assist the drilling personnel in tracking progress as the obstacle impeded area is traversed.

While the foregoing is directed to the preferred embodiment, the scope thereof is determined by the claims which follow:

We claim:

1. A method of drilling a horizontal hole beneath an obstacle in a terrain comprising the steps of:

(a) advancing a drill bit on a drill string along a selected pathway;

(b) measuring periodically (1) the location of the drill bit with respect to a reference system, and (2) the azimuth of the drill bit and drill string with respect to an azimuth line along a projected right of way line;

(c) transmitting the measured location to a receiver antenna above the terrain; and (d) determining the pathway of the drilled hole by periodically determining the transmitter location from the transmitted measurements.

2. The method of claim 1 wherein the step of periodically measuring the location of the drill bit includes the step of measuring the inclination angle of the drill bit with respect to a horizontal plane.

3. The method of claim 1 wherein the step of periodically measuring the location of the drill bit measures the angular position of the drill bit.

4. The method of claim 3 including the step of measuring the length of a drill pipe connecting from a drilling rig extending to the drill bit.

5. A method of determining the pathway of a hole while drilling a horizontal hole beneath an obstacle on a terrain wherein a projected a right of way is extended over the obstacle in the terrain and the method comprises the steps of:

(a) positioning left and right parallel strip antennas along the projected right of way line;

(b) advancing a drill string from a drilling rig to move a drill bit while drilling a horizontal hole along the projected right of way, and periodically during drilling transmitting from a transmitter at the drill bit a transmitted signal;

(c) receiving in the strip antennas the transmitted signal; and (d) comparing the relative amplitudes of the received signals at the two antennas to determine deviation of the drill hole as evidenced by the received signals during drilling while advancing the drill bit along the projected right of way.

6. The method of claim 5 including the step of changing the direction of the drill bit and drill string to maintain alignment with the projected right of way.

7. The method of claim 5 including the step of measuring the drill bit depth under the projected right of way.

8. The method of claim 7 including the step of measuring the length of the drill string during drilling, and further including the step of aligning the drill string under the projected right of way.

9. The method of claim 5 including the step of initially installing an inclination measuring means at the drill bit, and providing angle measurements therefrom to said transmitter, and transmitting said measurements to the antennas during drilling.

10. The method of claim 9 wherein said inclination measuring means is operated to measure inclination.

11. The method of claim 5 wherein said antennas are placed on the ground spaced by a distance of up to two times the anticipated depth of the horizontal hole.

12. An apparatus for providing data during drilling of a horizontal hole beneath an obstacle on a terrain wherein the apparatus comprises:

(a) drill bit supported transmitter and angle measuring sensor means input thereto for forming an angular measurement of the drill bit position with respect to a coordinate system at the drill bit;

(b) antenna means positioned along the projected path of the horizontally drilled hole under a projected right of way;

(c) receiver means connected to said antenna means; and (d) means for determining the location of the drill bit with reference to the projected right of way.

13. The apparatus of claim 12 wherein said angle measuring sensor measures drill bit inclination.

14. The apparatus of claim 12 wherein said antenna means comprises two strip antennas of finite and equal length, and said strip antennas are formed of N loops defined by a narrow planar ribbon.

15. The apparatus of claim 14 wherein said N loops are formed of two parallel wires joined at one end to define a loop.

16. The apparatus of claim 12 wherein said means for determining forms a ratio in signal amplitudes for two signals received at two separate locations above the terrain by said antenna means.

17. The apparatus of claim 16 wherein said antenna means comprises a pair of spaced strip antennas.

18. A method of measuring the pathway of a horizontal hole including the step of periodically measuring increments of the horizontal hole length extending from the beginning to the end of the horizontal hole during drilling by a drilling rig advancing a drill pipe supporting the drill bit, periodically measuring the location of the drill bit including the step of measuring the azimuth of the drill bit and drill pipe with respect to an azimuth line along a projected right of way, and wherein the periodic measurements are recorded and used serially as the drill bit is advanced.

19. The method of claim 18 wherein the periodic measurements related to drill bit inclination relative to a horizontal reference.

* * * * *